US006419519B1

(12) United States Patent
Young

(10) Patent No.: US 6,419,519 B1
(45) Date of Patent: Jul. 16, 2002

(54) STRAIN RELIEF FOR ELECTRICAL CONNECTORS

(75) Inventor: Thomas Frederic Young, Simi Valley, CA (US)

(73) Assignee: Glenair Inc., Glendale, CA (US)

( * ) Notice: Subject to any disclaimer, the term of this patent is extended or adjusted under 35 U.S.C. 154(b) by 0 days.

(21) Appl. No.: 09/631,054

(22) Filed: Aug. 1, 2000

(51) Int. Cl.[7] ..... H01R 13/56
(52) U.S. Cl. ..... 439/446; 439/471
(58) Field of Search ..... 439/446, 470, 439/471, 472, 31, 473

(56) References Cited

U.S. PATENT DOCUMENTS

| | | | | | |
|---|---|---|---|---|---|
| 3,190,978 | A | * | 6/1965 | Huget | 439/290 X |
| 3,603,913 | A | * | 9/1971 | Hasty, Jr. | 439/471 |
| 3,732,527 | A | * | 5/1973 | McKnight | 439/471 |
| 3,909,099 | A | * | 9/1975 | Winkler | 439/472 X |
| 4,500,154 | A | * | 2/1985 | Collins | 439/313 |
| 4,564,255 | A | * | 1/1986 | Kirma | 439/471 |
| 5,211,576 | A | * | 5/1993 | Tonkiss et al. | 439/462 |
| 5,380,219 | A | * | 1/1995 | Klier | 439/446 |
| 5,458,501 | A | * | 10/1995 | Lazaro, Jr. et al. | 439/318 |
| 5,580,278 | A | * | 12/1996 | Fowler et al. | 439/609 |
| 5,681,171 | A | * | 10/1997 | Park | 439/31 |
| 5,692,921 | A | * | 12/1997 | Jennings | 439/346 |
| 5,772,447 | A | * | 6/1998 | Cheung | 439/31 |
| 6,027,352 | A | * | 2/2000 | Byrne | 439/215 |
| 6,196,865 | B1 | * | 3/2001 | Ruffel et al. | 439/472 |

FOREIGN PATENT DOCUMENTS

| | | | | |
|---|---|---|---|---|
| DE | 3135781 | * | 3/1983 | H01R/13/506 |

* cited by examiner

*Primary Examiner*—Brian Sircus
*Assistant Examiner*—Son V. Nguyen

(57) ABSTRACT

A backshell adapter assembly includes a clamp body and one or more extending strain relief arms, pivotably connected to the clamp body. The strain relief arms are adapted to receive a pair of opposing saddle clamps or cable tie to provide radial clamping of a wire bundle relative to the backshell adapter assembly to prevent axial movement of the cable in response to axial forces thereupon. The extending strain relief arms are adapted to be rotated between various positions including −90° to +90°. Provisions may be provided for securing the extending arms at various detent positions relative to the axis of the clamp body. As such the need for separate tooling for different configurations is eliminated, thus lowering the cost of the device. In addition, the use of such backshell adapter assemblies is greatly simplified.

18 Claims, 6 Drawing Sheets

STRAIN RELIEF FOR ELECTRICAL CONNECTORS

BACKGROUND OF THE INVENTION

1. Field of the Invention

The present invention relates to an accessory for an electrical connector, also known as a backshell adapter assembly, and more particularly to a backshell adapter assembly which includes one or more pivotable strain relief arms which can be adjusted between various angles relative to the axis of the backshell adapter assembly to provide radial clamping of a wire bundle to prevent axial forces from damaging the wire termination at the electrical connector.

2. Description of the Prior Art

Backshell adapter assemblies are generally known in the art. Such backshell adapter assemblies normally provide a transition from a plurality of electrical conductors to an electrical connector. An example of a backshell adapter assembly is disclosed in commonly owned U.S. Pat. No. 5,580,278, hereby incorporated by reference.

Various types of backshell adapter assemblies are known and configured to provide a relatively wide range of options, depending on the particular application. One such application is strain relief. In particular, backshell adapter assemblies are known which provide a radial clamping force relative to the wire bundle to prevent axial forces from damaging the termination of the wires at the electrical connector. Such known backshell adapter assemblies normally include a mechanical saddle clamp which, in turn, includes a pair of complementary saddle bars, rigidly secured to the backshell adapter assembly by way of extending strain relief arms. Conventional fasteners are used to tighten the saddle bars together to provide a radial clamping force to prevent the cable or wire bundle from moving in an axial direction.

Depending on the application, various configurations of the backshell adapter assemblies with saddle clamps are known in which the angle of the axes of the strain relief arms relative to the axis of the backshell adapter assembly varies. For example, 0°, 45° and 90° configurations are all known. In each of these configurations, the backshell adapter assembly includes a pair of extending strain relief arms for connecting the saddle clamps to the backshell adapter assembly, fixed at either 0°, 45° or 90° relative to the axis of the backshell adapter assembly. Since the strain relief arms are fixed relative to the backshell adapter assembly, the 0°, 45° and 90° backshell adapter assemblies with strain relief must be manufactured as separate products. As such, separate tooling must be provided for each of the various configurations which increases the cost of backshell adapter assemblies with a strain relief function. In addition, the end user must have an accurate count of each of the configurations required before ordering the backshell adapter assemblies. Should a field change be required, additional backshell adapter assemblies may be required to be ordered. As such there is a need to optimize backshell adapter assemblies with various configurations.

SUMMARY OF THE INVENTION

Briefly, the present invention relates to a backshell adapter assembly which includes a clamp body and one or more extending strain relief arms, pivotably connected to the clamp body. The strain relief arms are adapted to receive a pair of opposing saddle clamps or a cable tie to provide radial clamping of a wire bundle relative to the backshell adapter assembly to prevent axial movement of the cable in response to axial forces thereupon. The extending strain relief arms are adapted to be rotated between various positions, for example, −90° to +90°. Provisions may be provided for securing the extending arms at various detent positions relative to the axis of the clamp body. As such the need for separate tooling for different configurations is eliminated, thus lowering the cost of the device. In addition, the use of such backshell adapter assemblies is greatly simplified.

DESCRIPTION OF THE DRAWINGS

These and other advantages of the invention will be readily apparent upon consideration of the following specification and attached drawing wherein.

DETAILED DESCRIPTION OF THE INVENTION

Figure 5:
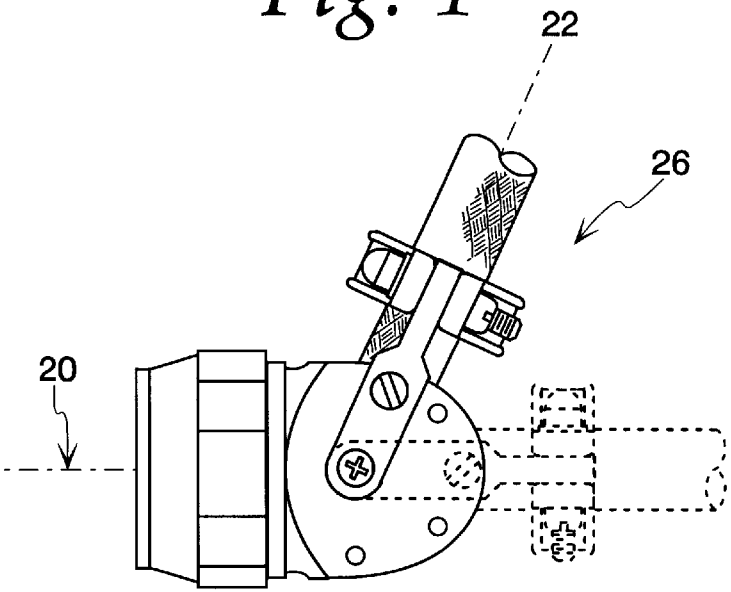
FIG. 5 is similar to FIG. 4 shown configured at a second angle.

The present invention relates to a backshell adapter assembly which includes pivotable strain relief arms that are adapted to rotate between various angles, for example −90° to +90°, defined between a cable axis 22 (FIG. 5) and an axis 21 of the backshell adapter assembly. As used herein, the term configuration refers to the relationship between the axis 20 and the axis 22 as shown in FIG. 5. The backshell adapter assembly in accordance with the present invention eliminates the needs to provide separate tooling for backshell adapter assemblies having different configurations. Not only do the pivotable strain relief arms reduce the cost of such backshell adapter assemblies but also facilitate the use of such devices. In particular, an accurate count of all of the various configurations is no longer required in order to order the backshell adapter assemblies. With the present invention, the user now need only determine the total number of backshell adapter assemblies required for the job.

Figure 9:
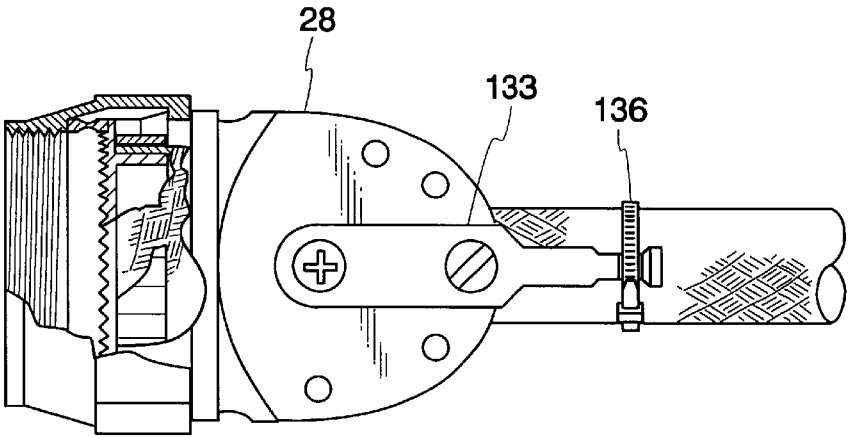
FIG. 9 is similar to FIG. 8 except it is a front view, shown partially in section.
Figure 11:
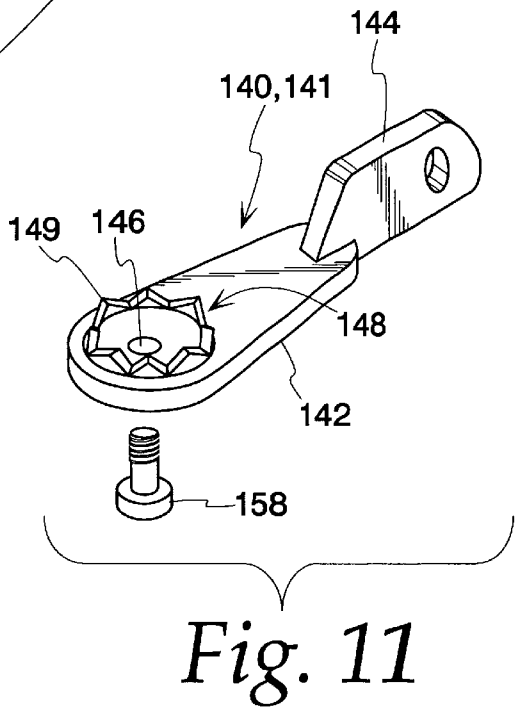
FIG. 11 is a perspective view of an alternate embodiment of the strain relief arm in accordance with present invention formed with a planetary gear around the pivot axis.
Figure 12:
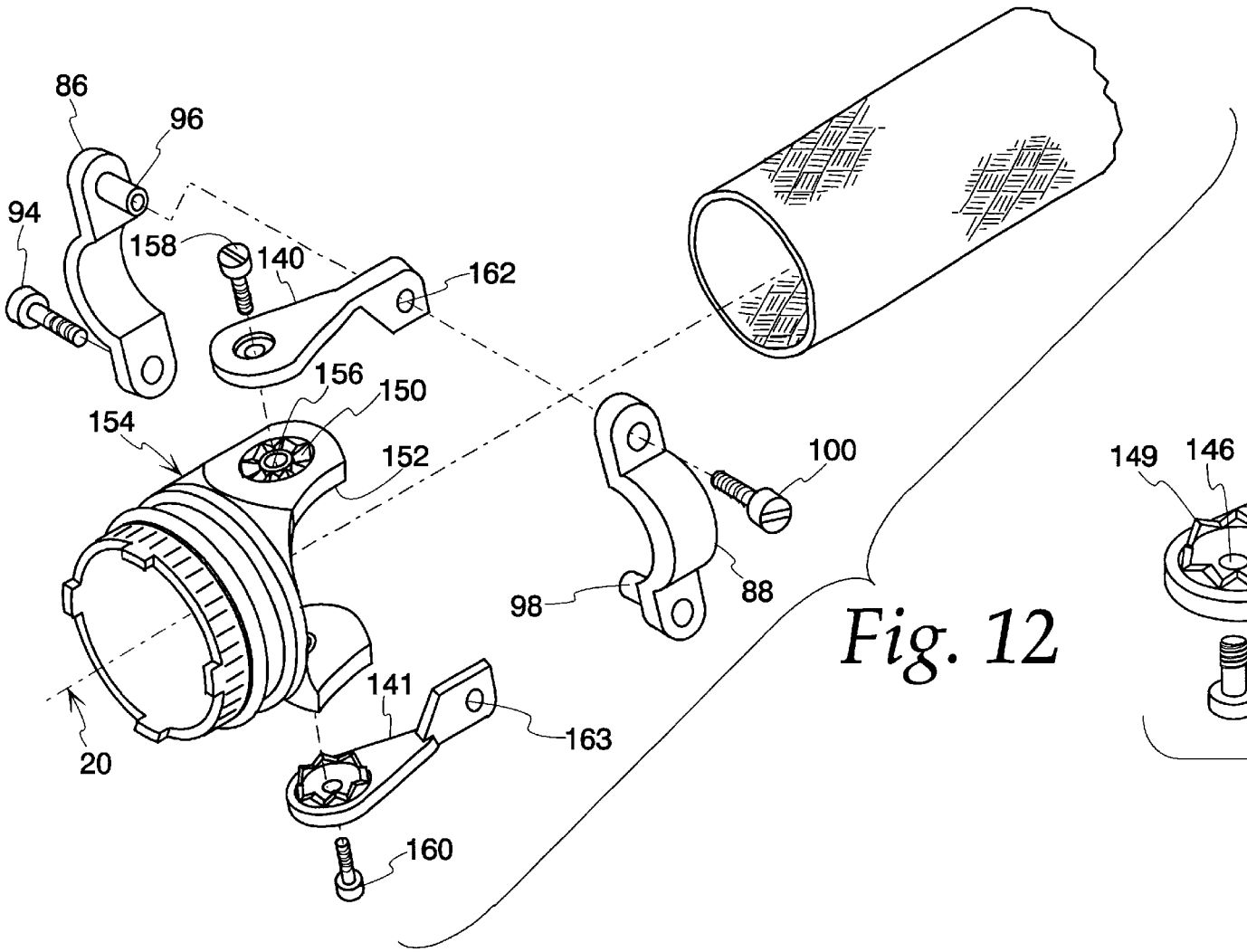
FIG. 12 is an exploded perspective view of a backshell adapter assembly which incorporates the strain relief arm illustrated in FIG. 11.
Figures 13, 14:
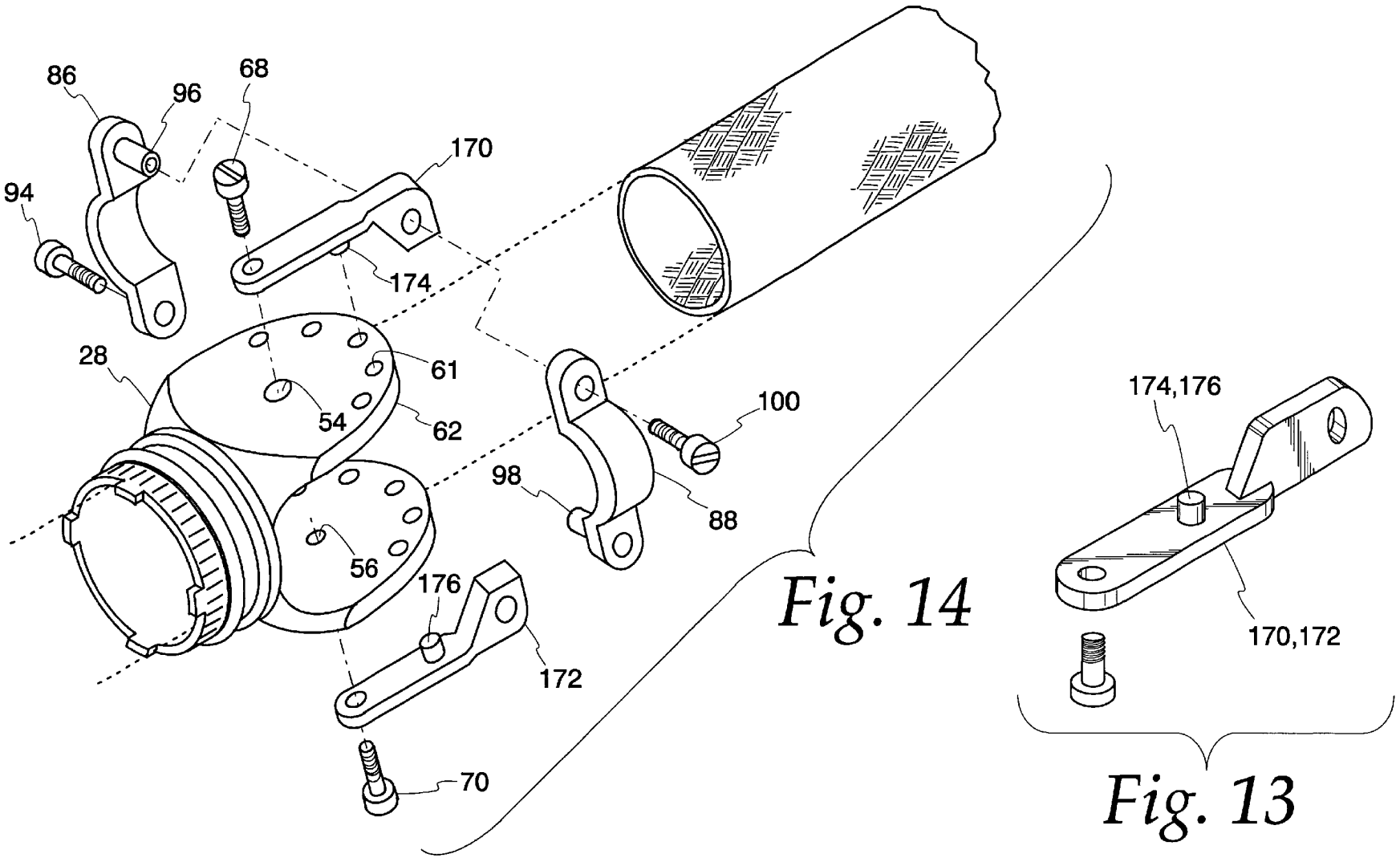
FIG. 13 is perspective view of another alternate embodiment of the strain relief arm in accordance with the present invention formed with a locking pin.
FIG. 14 is an exploded perspective view of a backshell adapter assembly which incorporates the strain relief arm illustrated in FIG. 13

Four embodiments of the invention are illustrated. FIGS. 1 through 7 illustrate a first embodiment of a backshell adapter assembly with pivotable strain relief arms in accordance with the present invention which utilize a saddle clamp to provide a radial clamping force on a cable. In an alternate embodiment of the invention, as illustrated in FIGS. 8 and 9, one or more strain relief arms may be provided and configured to be secured to the cable by way of a cable plastic tie. FIGS. 11 and 12 illustrate a third embodiment while FIGS. 13 and 14 illustrate a fourth embodiment of the invention. In all aspects of the invention, the strain relief arms are easily field configured to provide virtually any configuration of the strain relief arms, for example, −90° to +90°.

Figure 15:
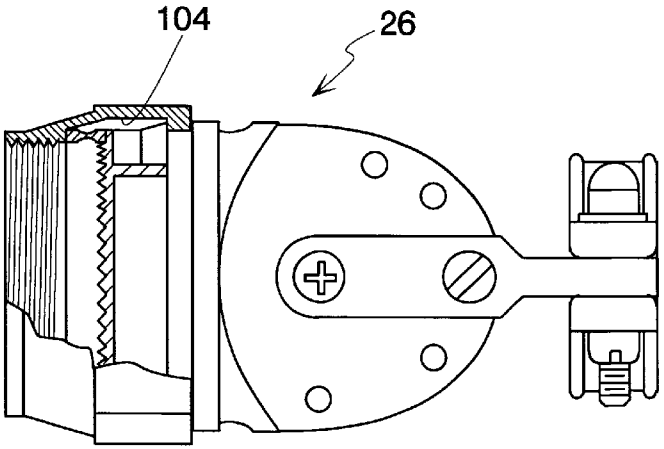
FIG. 15 is similar to FIG. 1 except the backshell adapter assembly is configured for use with a non-shielded cable.

Additionally, the principles of the present invention are applicable to both shielded and non-shielded cable applications. For example, FIGS. 1–14 illustrate backshell adapter assemblies configured for use with shielded cables. FIG. 15 illustrates an exemplary embodiment of a backshell adapter assembly in accordance with the present invention, configured for use with non-shielded cables.

Moreover, specific locking mechanisms are shown with specific detent positions. The principles of the present invention are applicable to embodiments with various types of locking mechanisms in addition to those shown and embodiments without detent positions. It is only important that the strain relief arms be secured in place after the assembly has been configured to the desired angle.

Figure 1:
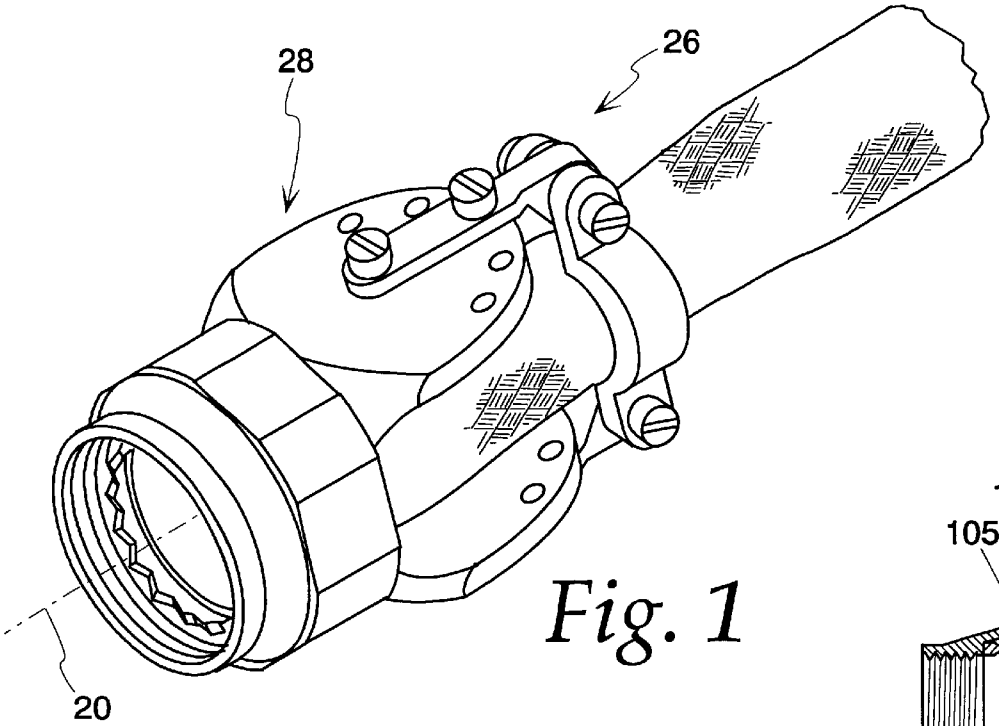
FIG. 1 is a perspective view of one embodiment of a backshell adapter assembly with a pivotable strain relief mechanism in accordance with the present invention, shown at 0° relative to the axis of the backshell adapter assembly and illustrated clamping a shielded cable.
Figure 3:
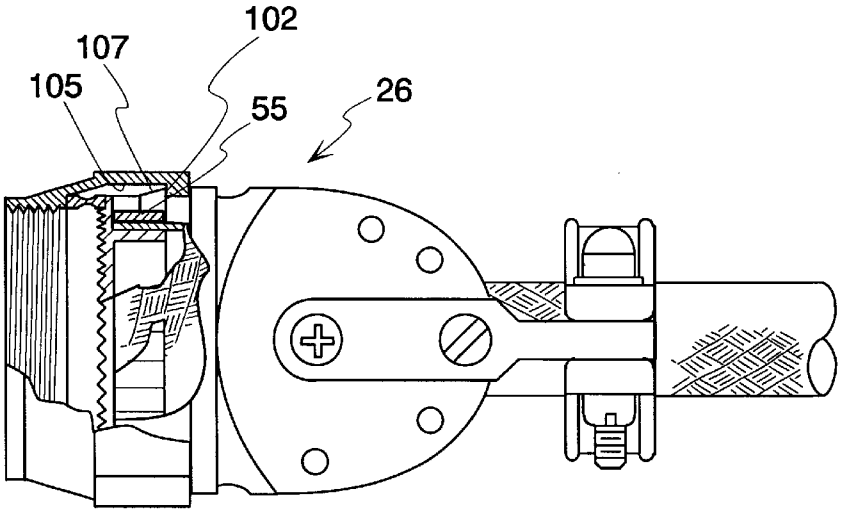
FIG. 3 is a front view of the backshell adapter assembly illustrated in FIG. 1, shown partially in section.

Turning to FIGS. 1–7, the backshell adapter assembly with pivotable strain relief arms in accordance with the present invention is generally identified with the reference numeral 26. The backshell adapter assembly 26 includes a clamp body 28 formed, for example, from various materials, such as an aluminum alloy, stainless steel or a composite plastic material. The clamp body 28 includes a ring portion 30 (FIG. 2) and two flat surfaces or plate portions 32 and 34. The plate portions 32 and 34 are spaced apart and disposed to be generally parallel to the axis 20. The plate portions 32 and 34 are connected to the ring portion 30 by a pair of shoulders 36 and 38. The spacing between the plate portions 32 and 34 as well as the diameter of the ring portion 30 are selected to receive a cable 40, for example, a shielded cable as shown in FIG. 1 or alternatively are configured to receive a non-shielded cable (not shown) as in the embodiment illustrated in FIG. 15.

The ring portion 30 may be provided with a number of extending tabs 44, 46, 48 and 50, which extend in an axial direction. These tabs 44, 46, 48 and 50 cooperate with corresponding slots, generally identified with the reference numeral 52, formed in a cable termination ring 53. The cable termination ring 53 is secured to the cable 40 and does not form a part of the back shell adapter assembly 26. The cable termination ring 53 and in particular the slots 52 formed therein cooperate with the axially extending tabs 44, 46, 48 and 50 on the ring portion 30 of the clamp body 28 to prevent rotation of the cable 40 relative to the backshell adapter assembly 26. One or more grounding rings 55, 103 may be provided. The grounding rings 55, 103 may be used in applications where a continuous electrical ground path is required from the cable shield to the clamp body 28 and electrical connector 104 to provide RFI/EMI shielding. The grounding rings 55, 103 are not required in non-shielded cable applications.

In accordance with an important aspect of the invention, the flat surface plate portions 32 and 34 of the clamp body 28 are provided with aligned apertures 54 and 56 which define a pivot axis 58. These apertures 54 and 56 are used to pivotably attach a pair of opposing strain relief arms 59 and 60 to the clamp body 28. Once the desired configuration angle is selected, the strain relief arms 59 and 60 are secured in place. Various means may be used to secure the stain relief arms 59 and 60 relative to the plate portions 32 and 34 of the clamp body 28. As shown, a plurality of apertures, generally identified with the reference numeral 61, are radially disposed along an extending arcuate surface 62 of the plate portions 32 and 34. These apertures 61 define detent positions which enable the strain relief arms 59 and 60 to be locked at various detent configuration angles relative to the clamp body 28. Five apertures 60 are shown. More or less apertures may be used. Other configurations are contemplated which do not require detent positions. In those configurations (not shown), the clamp body 28 need not include the apertures 61. All such configurations are considered to be within the broad scope of the invention.

In the exemplary embodiment illustrated, the strain relief arms 59 and 60 are provided with a pair of apertures 64 and 66. These apertures 64 and 66 are adapted to be aligned with the apertures 54 and 56 in the plate portions 32 and 34, respectively, of the clamp body 28 to enable the strain relief arms 59 and 60 to be pivotably coupled to the clamp body 28 with suitable fasteners 68 and 70. The fasteners 68 and 70 may be pins, rivets or screws or any means which enables the strain relief arms 59 and 60 to pivot with respect to the clamp body 28. In the embodiments illustrated, the strain relief arms 59 and 60 may also be provided with a pair of spaced apart apertures 72 and 74 that are adapted to be aligned with one of the apertures 61 along the extending arcuate surfaces 62 of the plate portions 32 and 34 of the clamp body 28. These apertures 72 and 74 enable the strain relief arms 59 and 60 to be secured at a selected configuration angle relative to the clamp body 28 by way of suitable fasteners 76 and 78. Various types of fasteners, such as pins, rivets and screws may be used for the fasteners 76 and 78.

The strain relief arms 59 and 60 may be formed with extending flange portions 82 and 84. These extending flange portions 82 and 84 may be used to secure a pair of opposing saddle bars 86 and 88. Each of the saddle bars 86 and 88 may be formed with apertures, generally identified with the reference numeral 93, on opposing ends. These apertures 93 are adapted to be aligned with the apertures 82 and 84 on the flange portions 82 and 84 to enable the saddle bars 86 and 88 to be secured to the strain relief arms 59 and 60 with suitable fasteners, for example, a pair of screws 94 and 100 and a pair of elongated captured nuts 96 and 98.

Figure 6:
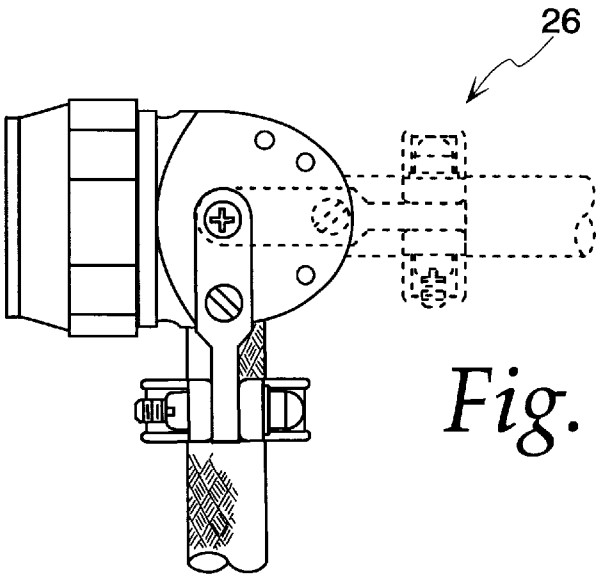
FIG. 6 is similar to FIG. 4 but shown with the strain relief members configured at a third angle.
Figure 7:
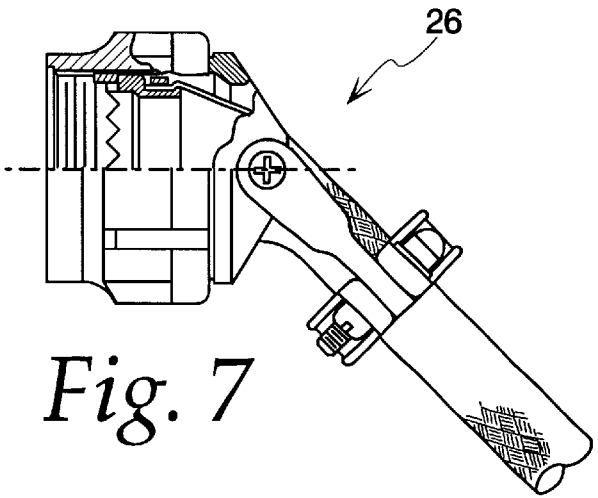
FIG. 7 is similar to FIG. 4, but shown partially in section and configured at a fourth angle.
Figure 4:
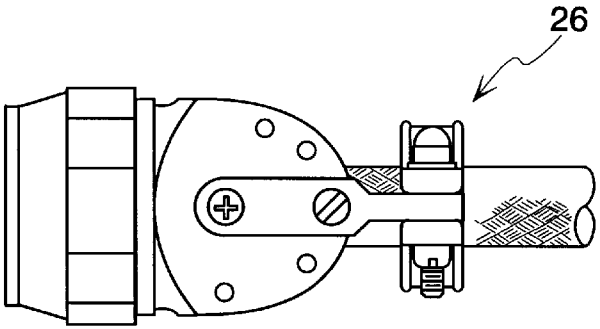
FIG. 4 is a front view of the backshell adapter assembly illustrated in FIG. 1, shown with the strain relief members configured at a first angle relative to the axis of the backshell adapter assembly.
Figure 8:
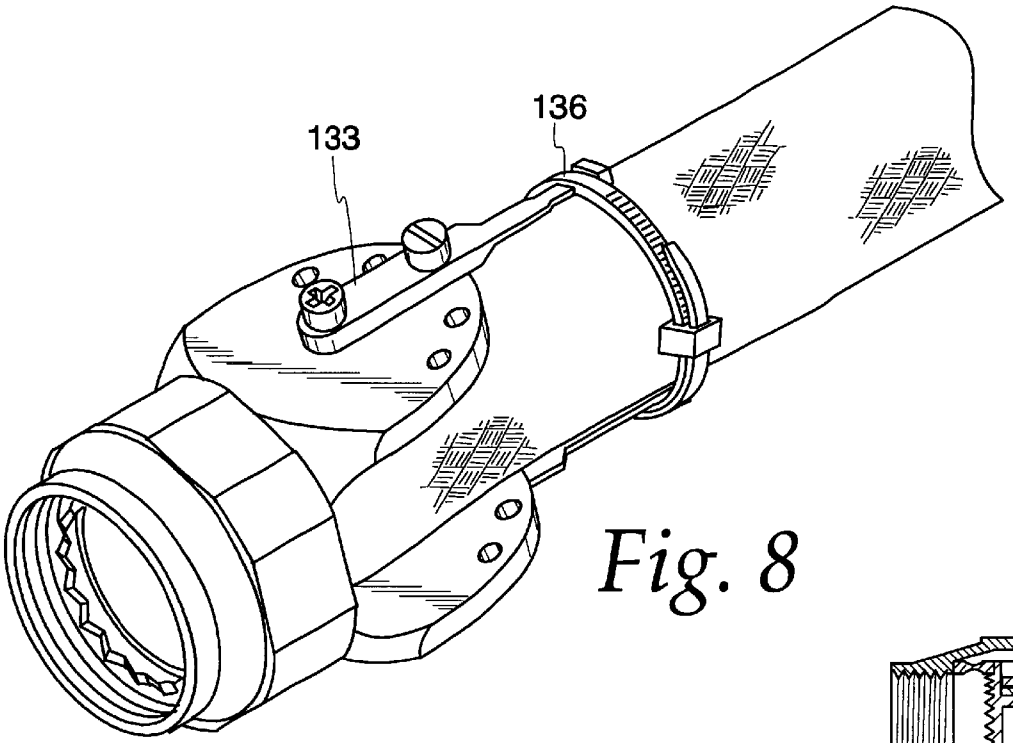
FIG. 8 is a perspective view of an alternate embodiment of the invention in which the strain relief arms are configured to receive a cable tie, shown with the strain relief arms at 0° relative to the axis of the backshell adapter assembly.
Figure 10:
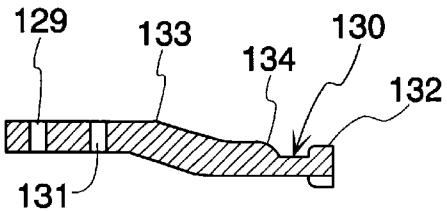
FIG. 10 is a sectional view of the strain relief arm illustrated in FIGS. 8 and 9.

As shown in FIGS. 4–7, various configurations of the strain relief arms 59 and 60 can be obtained rather quickly and easily, thus simplifying the manufacturing process as well as ordering process for backshell adapter assemblies with strain relief capabilities. For example, FIG. 4 illustrates a 0° configuration in which the axis 22 of the strain relief arms 59 and 60 is at 0° relative to the axis 20. FIG. 5 illustrates a configuration in which axis 22 of the strain relief arms 59 and 60 form a positive angle relative to the axis 20, for example +45°. FIG. 6 illustrates a configuration in which the axis 22 of the strain relief arms 59 and 60 forms a negative angle relative to the axis 22, for example −90°, while FIG. 7 illustrates a configuration at −45°. Various angular configurations are possible depending on the radial location of the apertures 61 along the arcuate surfaces 62 of the clamp body 28 in the embodiment shown in FIGS. 1–3.

Each of the leaf springs 108 and 110 includes a pin 114, 116 that is adapted to be received in apertures 118 provided in the coupling nut 106. The coupling nut 106 also includes internal threads, generally identified with the reference numeral 120, that are adapted to mate with corresponding threads 122 on the electrical connector 104 or another backshell.

The electrical connector 104 further includes anti-rotation teeth, generally identified with the reference 126, which cooperate with corresponding teeth 128 formed on the termination ring 52, to prevent rotation of the electrical connector 104 relative to the backshell adapter assembly 26.

An alternate embodiment of the invention as illustrated in FIGS. 8 and 9. This embodiment is similar to the embodiment illustrated in FIGS. 1–7 with the exception of the configuration of the strain relief arms 59 and 60. In this embodiment, the strain relief arms, generally identified with the reference numeral 133, are configured to eliminate the need for a saddle clamp. In this embodiment, one or two strain relief arms 133 may be provided and radially disposed adjacent the clamp body 28. The strain relief arms 133 are configured with a notch 130 disposed between a stop 132 and a shoulder 134. The configuration is adapted to capture a cable tie 136 within the notch 130 to enable the strain relief arm 133 to be secured to the cable 40. The strain relief arm 133 is adapted to pivot relative to the clamp body 28 in a similar manner as the embodiments illustrated in FIGS. 1–7 and thus includes an apertures 129. In embodiments, such as illustrated in FIG. 8, the strain relief arm 133 may be provided with a second aperture 131 for preventing rotation of the strain relief arm 133 relative to the clamp body 28. The second aperture 131 may be omitted when detent positions are not desired and in embodiments of the strain relief arms which include other locking mechanisms, such as planetary gear, similar to FIG. 11, or a locking pin, similar to FIG. 13.

The embodiment illustrated in FIGS. 8 and 9 contemplate the use of one or two strain relief arms 133. In configurations in which two strain relief arms 133 are utilized, the clamp body 28 is the same as illustrated in embodiment illustrated in FIGS. 1–7. In an embodiment in which only one strain relief arm 133 is utilized, the clamp body is essentially the same as the clamp body 28 (FIG. 2) except only a single plate portion 32 is provided. The clamp body 28 is also used in embodiments in which the strain relief arm 133 is provided with a locking pin, similar to FIG. 13. Moreover in embodiments in which the strain relief arms 128 are provided with a locking mechanism, such as a planetary gear, similar to FIG. 11, a clamp body similar to FIG. 12 may be utilized.

Figure 2:
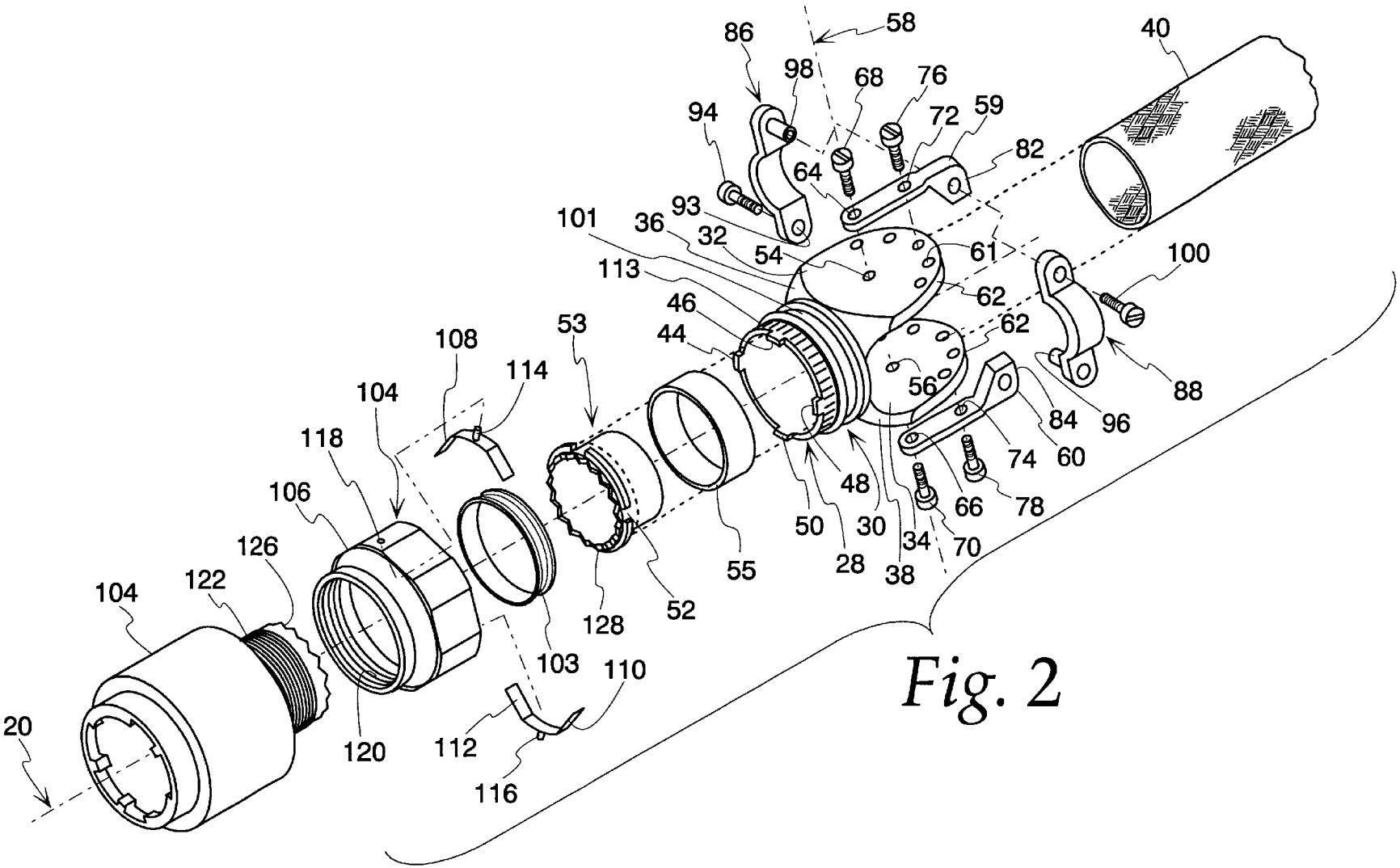
FIG. 2 is an exploded perspective view of the backshell adapter assembly illustrated in FIG. 1.

The third embodiment of the invention is illustrated in FIGS. 11 and 12. In this embodiment, alternate strain relief arms 140, 141 are provided as illustrated in FIG. 11. The strain relief arms 140, 141 each include a plate portion 142 and an extending flange 144. The plate portion 142 is provided with an aperture 146 which defines a pivot axis for the strain relief arms 140, 141. In this embodiment, various types of locking mechanisms are contemplated, for example, raised or recessed star gears, planetary gears or the like may be used to lock the strain relief arms 141, 142 in the position relative to the clamp body 154. An exemplary embodiment illustrating a planetary gear is illustrated. The planetary gear, generally identified reference 148, is concentrically formed around the aperture 146 and includes a plurality of teeth 149. The planetary gears 148 is adapted to cooperate with a corresponding planetary gear 150 formed in the flanged portion 152 of a clamp body 154 (FIG. 12). The flange portion 152 of the clamp body 154 also includes an aperture 156 concentrically disposed relative to the planetary gear 150. The planetary gears 148 and 150 prevent rotation of the strain relief arms 140, 141 when secured to the clamp body 154 while allowing virtually any configuration of the strain relief arms 140, 141 relative to the axis 20. Conventional fasteners 158 and 160 may be used to secure the strain relief arms 140 and 141 to the clamp body 154. In particular, once the desired configuration angle is selected, the aperture 146 in the strain relief arms 140 and 141 are aligned with the apertures 156 in the clamp body 154 and secured thereto by the fasteners 158 and 160. The fasteners 158 and 160 may either be loose as shown or captured relative to the strain relief arms 140, 141. The clamp body 154 is otherwise similar to the clamp body 28 (FIG. 2). The flange portions 144 of the strain relief arms 140 and 141 also include aperture 162 and 163 for securing a pair of saddle bars 86 and 88 thereto with conventional fasteners 94, 96, 98 and 100.

An alternate embodiment of the invention is illustrated in FIGS. 13 and 14. This embodiment is similar to the embodiment illustrated in FIGS. 1–7 except that the strain relief arms 170 and 172 are provided with locking pins 174 and 176. The locking pins 174, 176 are adapted to be received in the apertures 61 in the clamp body in lieu of fasteners. In all other respects, the embodiment illustrated in FIGS. 13 and 14 are virtually the same as the embodiment illustrated in FIGS. 1 through 7.

Obviously, many modifications and variations of the present invention are possible in light of the above teachings. Thus, it is to be understood that, within the scope of the appended claims, the invention may be practiced otherwise than as specifically described above.

I claim:

1. A backshell adapter assembly with a strain relief function comprising:

a clamp body having a ring portion defining a first axis and a pair of flat plate portions spaced apart and generally parallel to said first axis, each plate portion formed with a pivot hole with an annular groove;

a pair of extending strain relief arms, each arm defining opposing first and second ends, said first ends of said strain relief arms pivotably connected to said pivot holes in said pair of plate portions, said strain relief arms defining a second axis;

a coupling nut for providing a interface for an electrical device, said coupling nut formed as a ring adapted to be coupled to said annular groove on said clamp body to prevent axial movement therebetween and a set of threads for mating with the electrical device; and a pair of saddle bars adapted to be secured to said second ends of strain relief arms to provide radial clamping of a cable disposed between said pair of strain relief arms.

2. The backshell adapter assembly as recited in claim 1, wherein said electrical device is an electrical connector.

3. The backshell adapter assembly as recited in claim 1, wherein said electrical device is another backshell adapter assembly.

4. The backshell adapter assembly as recited in claim 1, wherein said pair of strain relief arms are configured to be secured in place relative to said clamp body with a locking mechanism.

5. The backshell adapter assembly as recited in claim 4, wherein said locking mechanism includes a gear.

6. The backshell adapter assembly as recited in claim 5, wherein said gear is a planetary gear.

7. The backshell adapter assembly as recited in claim 5, wherein said gear is a star gear.

8. The backshell adapter assembly as recited in claim 4, wherein said locking mechanism includes one or more additional holes formed in said flat plate portions of said clamp body for enabling each of said pair of strain relief arms to be secured thereto.

9. The backshell adapter assembly as recited in claim 4, wherein said locking mechanism is formed by providing planetary gears on at least one of said of plate portions of said clamp body and said at least one of said strain relief arms.

10. The backshell adapter assembly as recited in claim 4, wherein said locking mechanism includes a pin formed on at least one of said strain relief arms and said clamp body is provided with one or more apertures for receiving said pin to prevent rotation of said strain relief arms relative to said clamp body.

11. The backshell adapter assembling as recited in claim 1, wherein said strain relief arms are formed with flange portions which extend beyond said plate portions an said flange portions are formed with apertures and wherein each of said pair of saddle bars are adapted to be secured to said flange portions by way of said apertures and suitable fasteners.

12. A backshell adapter assembly with a strain relief function comprising:

a clamp body having a ring portion defining a first axis and a pair of flat plate portions spaced apart and generally parallel to said first axis, each plate portion formed with a pivot hole, said ring portion formed with an angular groove;

a pair of strain relief arms, each strain relief arm defining a first end and a second end, said first ends of said strain relief arms pivotably connected to said pivot holes on said pair of planes portions, said strain relief arms configured to extend beyond said plate portions, said strain relief arms defining a second axis and formed with notches for capturing a cable tie to thereby provide radial clamping of a cable disposed between said pair of strain relief arms; and a coupling nut for providing an interface to an electrical device, said coupling nut formed a ring adapted to be coupled to said annular groove on said clamp body and a second set of threads adapted to mate with the electrical device.

13. The backshell adapter assembly as recited in claim 12, wherein said electrical device is an electrical connector.

14. The backshell adapter as recited in claim 12, wherein said electrical device is a backshell adapter.

15. The backshell adapter assembly as recited in claim 12, further including a locking mechanism for locking one or more of said strain relief arms relative to said clamp body.

16. The backshell adapter as recited in claim 15, wherein said locking mechanism includes apertures formed in said strain relief arms and said plate portions of said clamp body to enable said strain relief arms to be secured relative to said clamp body by way of suitable fasteners.

17. The backshell adapter assembly as recited in claim 15, wherein said locking mechanism includes cooperating planetary gears formed on at least one plate portion of said clamp body and said at least one of said strain relief arms to prevent rotation of said at least strain relief arm relative to said at least one plate portion.

18. A backshell adapter assembly, with a strain relief function comprising:

a clamp body having a ring portion defining a first axis and a pair of spaced apart flat plate portions, each plate portion having a pivot hole generally parallel to said first axis, said ring portion formed with an annular groove;

a pair of strain relief arms, each strain relief arm defining a first end and a second end, said first ends of said strain relief arms pivotably connected to said pivot holes on said plate portions, said pair of strain relief arms configured to extend beyond said plate portions, said pair of strain relief arms defining a second as and formed with notches for capturing a cable tie; and a coupling nut for providing interface to an electrical device, said coupling nut formed as a ring coupled to said annular groove on said clamp body and a set of threads adapted to mate with the electrical device; and a locking mechanism for locking at least one of said pair of strain relief arms relative to said clamp body, wherein said locking mechanism includes a pin formed on one of said strain relief arms and wherein said plate portions of said clamp body are provided with one or more apertures for receiving said pin to prevent rotation of said strain relief arms relative to said clamp body.

* * * * *

UNITED STATES PATENT AND TRADEMARK OFFICE

CERTIFICATE OF CORRECTION

PATENT NO. : 6,419,519 B1
DATED : July 16, 2002
INVENTOR(S) : Young

It is certified that error appears in the above-identified patent and that said Letters Patent is hereby corrected as shown below:

Column 6,
Line 59, delete “to” and insert -- with --.

Column 7,
Line 30, delete “assembling” and insert -- assembly --.
Line 32, delete “an” and insert -- and --.
Line 43, delete “angular” and insert -- annular --.
Line 47, delete “planes” and insert -- plates --.

Column 8,
Line 36, delete “as” and insert -- axis --.

Signed and Sealed this

Twenty-sixth Day of November, 2002

*Attest:*

*Attesting Officer*

JAMES E. ROGAN
*Director of the United States Patent and Trademark Office*